US011602938B2

(12) United States Patent
Aoki et al.

(10) Patent No.: US 11,602,938 B2
(45) Date of Patent: Mar. 14, 2023

(54) PRINTING APPARATUS

(71) Applicant: Seiko Epson Corporation, Tokyo (JP)

(72) Inventors: Yuki Aoki, Shiojiri (JP); Tomohiro Yoda, Matsumoto (JP); Yasuo Naramatsu, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/558,736

(22) Filed: Dec. 22, 2021

(65) Prior Publication Data

US 2022/0203715 A1 Jun. 30, 2022

(30) Foreign Application Priority Data

Dec. 24, 2020 (JP) ..... JP2020-214763

(51) Int. Cl.
*B41J 11/00* (2006.01)

(52) U.S. Cl.
CPC ..... *B41J 11/00216* (2021.01)

(58) Field of Classification Search
CPC . B41J 11/00216; B41J 11/0022; B41J 11/002; B41J 11/0045
See application file for complete search history.

(56) References Cited

U.S. PATENT DOCUMENTS

2018/0004143 A1* 1/2018 Sasaki ..... G03G 15/605
2018/0056673 A1 3/2018 Suzuki

FOREIGN PATENT DOCUMENTS

JP 2018-001501 1/2018
JP 2018-034306 3/2018

* cited by examiner

*Primary Examiner* — Bradley W Thies
(74) *Attorney, Agent, or Firm* — Workman Nydegger

(57) ABSTRACT

A printing apparatus includes a transport unit configured to transport a medium in a transport direction, a printing unit configured to perform printing on the medium transported by the transport unit and supported by a platen, a downstream guiding unit as a medium guiding unit having a guide surface for guiding the medium downstream in the transport direction from the platen, a heating unit disposed at a position facing the guide surface, and configured to heat the medium, and a spacer provided above the guide surface, and configured to separate the medium from the guide surface.

10 Claims, 6 Drawing Sheets

| SPACER HEIGHT H1 (mm) | MEDIA DAMAGE EVALUATION |
|---|---|
| 0 | C |
| 10 | C |
| 15 | B |
| 20 | A |
| 25 | A |

PRINTING APPARATUS

The present application is based on, and claims priority from JP Application Serial Number 2020-214763, filed Dec. 24, 2020, the disclosure of which is hereby incorporated by reference herein in its entirety.

BACKGROUND

1. Technical Field

The disclosure relates to a printing apparatus.

2. Related Art

In the past, a printing apparatus has been known that discharges ink toward a medium, and that includes a heating unit that heats the medium after printing. For example, JP 2018-1501 A discloses a printing apparatus including a guiding unit having a guide surface for guiding a medium after printing, and a heating unit for heating the medium guided by the guiding unit. The printing apparatus suppresses condensation on the guide surface by releasing steam from a slit hole provided in the guide surface.

When a medium containing vinyl chloride as a material is used, and when an amount of moisture between the medium and the guide surface increases due to heating by the heating unit, there was a possibility that media damage such as a wrinkled medium may occur, and print quality may decrease. However, the printing apparatus described in JP 2018-1501 A, which reduces the amount of moisture between the medium and the guide surface, is provided with the slit hole in the guide surface, so there was a possibility that transport properties may be impaired depending on a type of the medium such as polyvinyl chloride. In other words, there has been a demand for a printing apparatus that, while ensuring transport properties of a medium, suppresses media damage.

SUMMARY

A printing apparatus includes a transport unit configured to transport a medium in a transport direction, a printing unit configured to perform printing on the medium transported by the transport unit and supported by a platen, a medium guiding unit having a guide surface for guiding the medium downstream in the transport direction from the platen, a heating unit disposed at a position facing the guide surface, and configured to heat the medium, and a spacer provided above the guide surface, and configured to separate the medium from the guide surface.

DESCRIPTION OF EXEMPLARY EMBODIMENTS

1. Exemplary Embodiment 1

Figure 1:
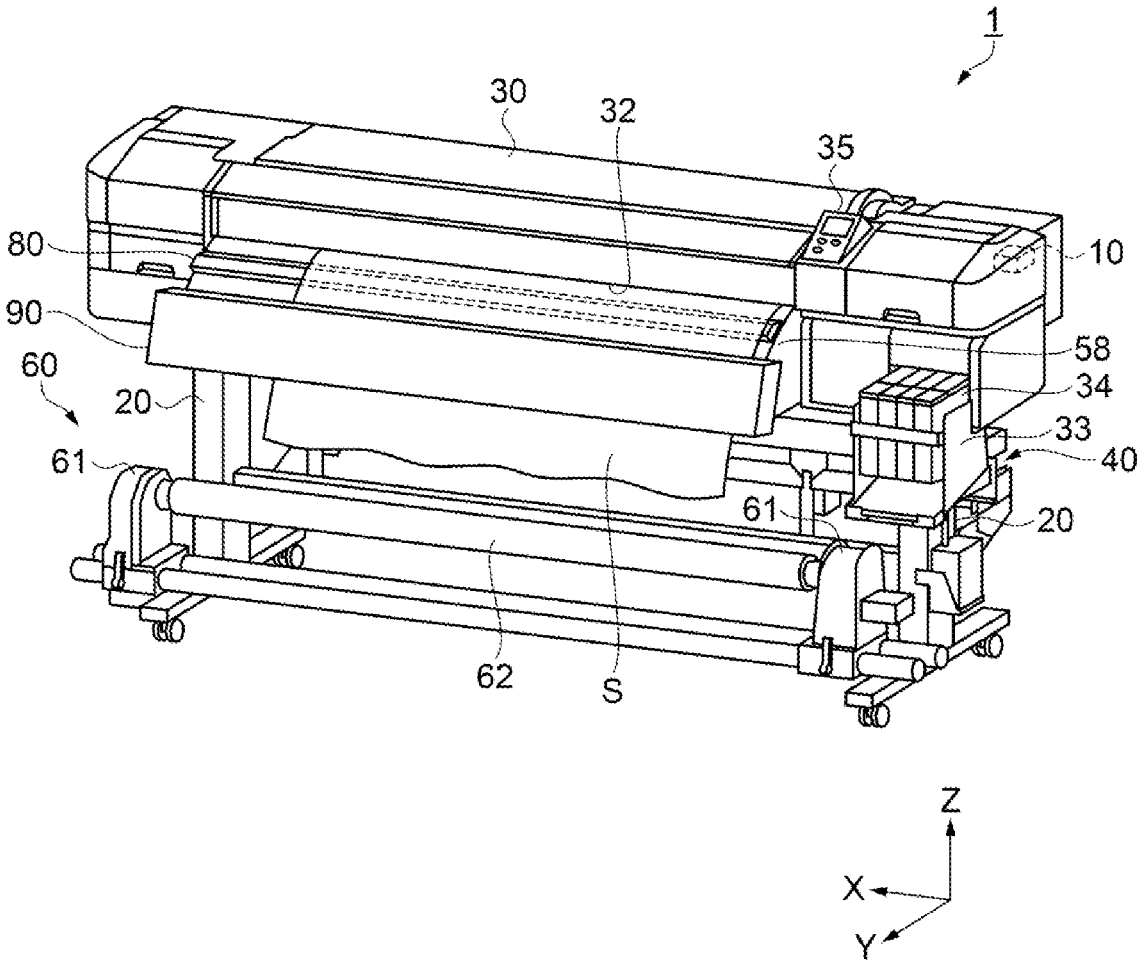
FIG. 1 is a perspective view illustrating a configuration of a printing apparatus according to Exemplary Embodiment 1.

A schematic configuration of a printing apparatus 1 according Exemplary Embodiment 1 will be described. Note that, in coordinates indicated in the drawings, both directions along a Z-axis are up-down directions, an arrow direction is "above", both directions along an X-axis are left-right directions, an arrow direction is "left", both directions along a Y-axis are front-back directions, and an arrow direction is "front". In addition, both directions along the X-axis correspond to a main scanning direction, and the Y-axis corresponds to a transport direction of a medium S in a printing unit 70. In addition, a positional relationship along the transport direction is also referred to as "upstream" or "downstream".

Figure 2:
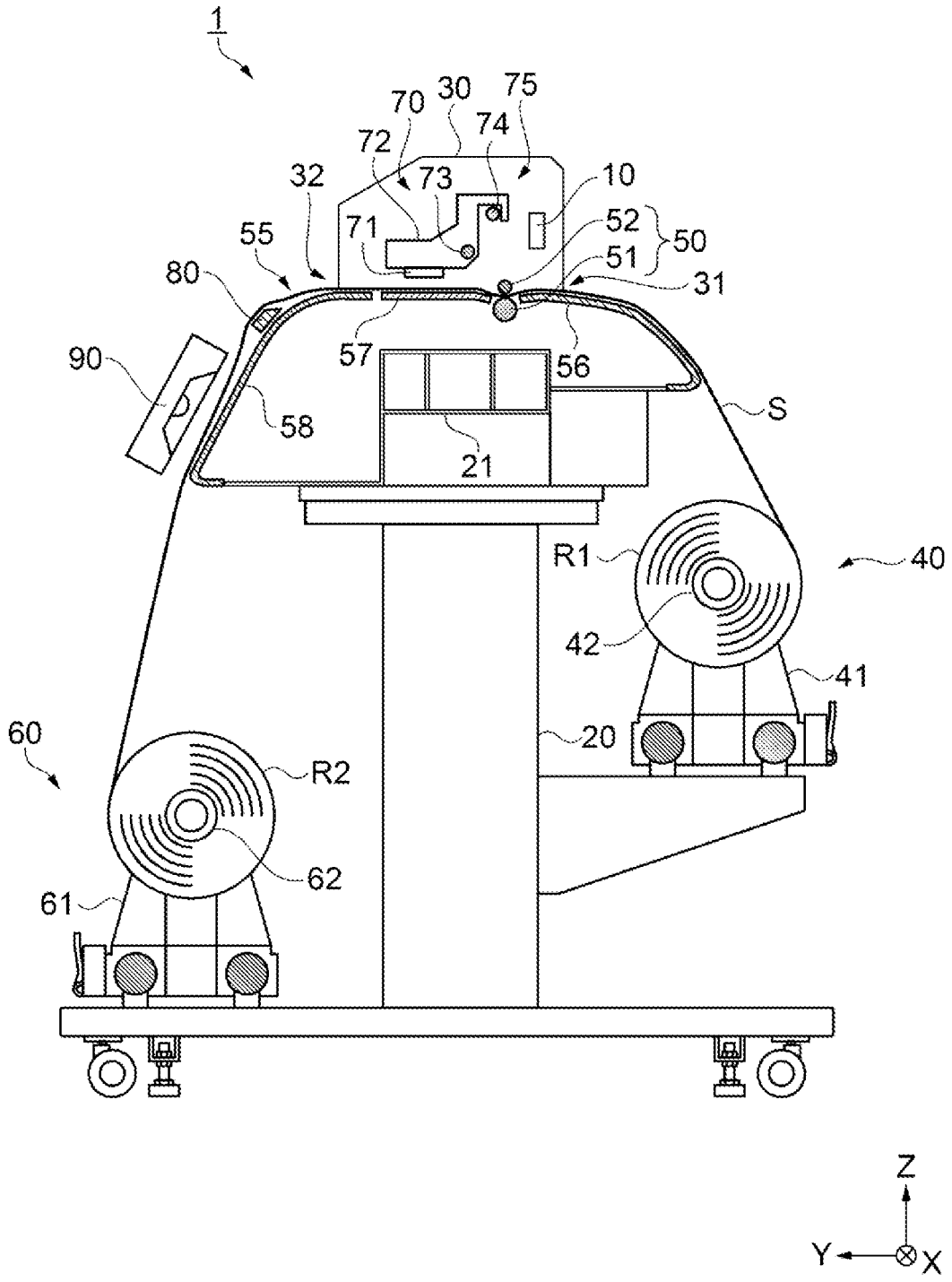
FIG. 2 is a cross-sectional view illustrating a schematic configuration of the printing apparatus.

As illustrated in FIG. 1 and FIG. 2, the printing apparatus 1 is configured to include a supply unit 40, a transport unit 50, a guiding unit 55, a winding unit 60, the printing unit 70, a heating unit 90, and a control unit 10 for controlling each unit of the printing apparatus 1. The supply unit 40 and the winding unit 60 are provided at a pair of legs 20 that are separated apart in an X direction. The transport unit 50 and the guiding unit 55 are supported by a base frame 21 that is installed across the pair of legs 20. The printing unit 70, and the control unit 10 are provided inside a substantially cuboid housing 30 that is positioned above the transport unit 50 and the guiding unit 55, long along the X-axis, and supported by the base frame 21.

The supply unit 40 is provided at a rear lower portion of the housing 30. A roll body R1 in which the medium S, which is unused, is wound around a core tube 42 is held in the supply unit 40. The supply unit 40 includes a pair of holders 41 that sandwich both ends of the core tube 42. One of the holders 41 is provided with a motor for supplying rotary power to the core tube 42. By the motor driven and the core tube 42 rotating, the medium S unwound from the roll body R1 is supplied to the printing unit 70. Note that, the roll bodies R1 which are different in width or the number of times of winding of the medium S, and that have a plurality of sizes are replaceably loaded to the supply unit 40.

The winding unit 60 is provided at a front lower portion of the housing 30. The winding unit 60 is formed with a roll body R2 obtained by winding the medium S, after printing in the printing unit 70, around the core tube 62. The winding unit 60 includes a pair of holders 61 that sandwich both ends of the core tube 62. One of the holders 61 is provided with a motor for supplying rotary power to the core tube 62. By the motor driven and the core tube 62 rotating, the medium S is wound around the core tube 62. Note that, the winding unit 60 may be configured to include a tension roller that presses a back surface side of the medium S hanging down under its own weight and applies tension to the medium S that is wound around the core tube 62.

Figure 3:
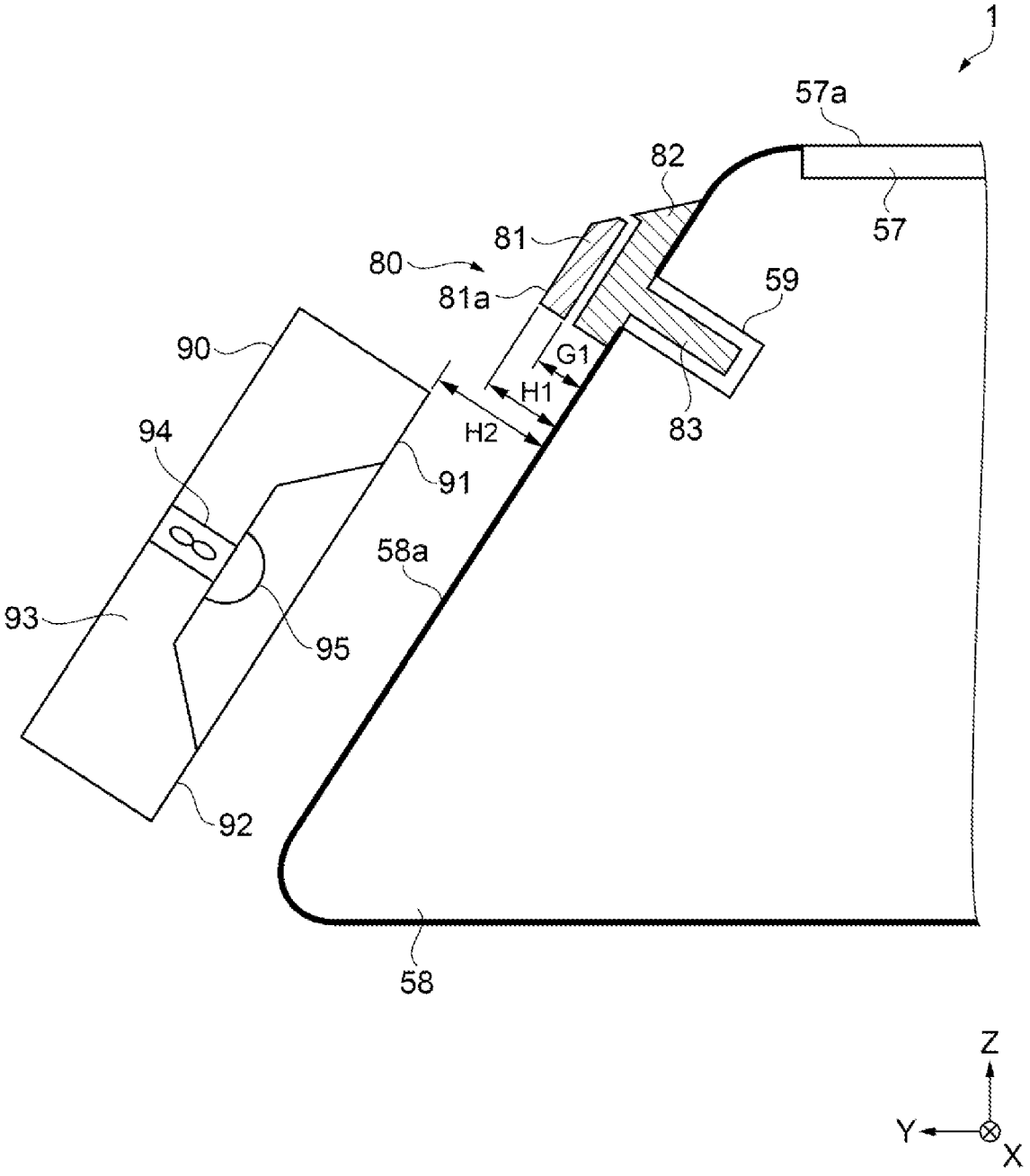
FIG. 3 is a cross-sectional view illustrating a spacer and a heating unit enlarged.

As illustrated in FIG. 2 and FIG. 3, the guiding unit 55 includes an upstream guiding unit 56, a platen 57, and a downstream guiding unit 58 as a medium guiding unit. The platen 57 has a plate shape, which is long along the X-axis, and is provided at a position facing the printing unit 70. The platen 57 includes a support face 57*a* supporting the medium S, and supports the medium S, on which the printing unit 70 prints, from below. Note that, in FIG. 3, illustration of the housing 30 and the printing unit 70 is omitted.

As illustrated in FIG. 2, the upstream guiding unit 56 is provided upstream the platen 57. Further, a supplying port 31 for supplying the medium S inside the housing 30 is formed at a rear surface of the housing 30 at a position on an upper side of the upstream guiding unit 56. The upstream guiding unit 56 guides the medium S supplied from the supply unit 40 to the platen 57 via the supplying port 31.

As illustrated in FIG. 2 and FIG. 3, the downstream guiding unit 58 is provided downstream the platen 57. The downstream guiding unit 58 includes a guide surface 58*a* that guides the medium S downstream in the transport direction from the platen 57. Further, a discharge port 32 for discharging the medium S outside the housing 30 is formed at a front surface of the housing 30 at a position on an upper side of the downstream guiding unit 58. The downstream guiding unit 58 guides the medium S, after printing in the printing unit 70, to the winding unit 60 via the discharge port 32.

The transport unit 50 transports the medium S in the transport direction. The transport unit 50 includes a driving roller 51 disposed on a lower side of the medium S and rotationally driven, a driven roller 52 disposed on an upper side of the driving roller 51 and rotating in accordance with rotation of the driving roller 51, and a motor for supplying rotary power to the driving roller 51. The driving roller 51 extends in a direction intersecting the transport direction of the medium S, and is provided between the platen 57 and the upstream guiding unit 56. The driven roller 52 is configured to be movable so as to be separated away from or pressed in contact with the driving roller 51. When the motor is driven and the driving roller 51 is rotationally driven, the medium S sandwiched between the driven roller 52 and the driving roller 51 is transported in the transport direction.

The printing unit 70 prints on the medium S transported by the transport unit 50, and supported by the platen 57. The printing unit 70 is disposed above a position where the platen 57 is disposed. The printing unit 70 includes a head 71 for discharging ink onto the medium S on the platen 57, a carriage 72 at which the head 71 is mounted, and a head moving unit 75 for moving the carriage 72 in the main scanning direction.

The head moving unit 75 moves the carriage 72 in the main scanning direction. The carriage 72 is supported by guide rails 73 and 74 disposed along the X-axis, and is configured to be reciprocally movable in the main scanning direction by the head moving unit 75. For the mechanism of the head moving unit 75, a mechanism including a combination of a ball screw and a ball nut, a linear guide mechanism, or the like may be employed. Furthermore, the head moving unit 75 includes a motor that is a power source for moving the carriage 72 along an X-axis direction. When the motor is driven, the head 71 reciprocates in the main scanning direction with the carriage 72. Printing is performed by the head 71 discharging ink onto the medium S while moving in the main scanning direction. Note that, examples of the medium S include standard paper, high-quality paper, and gloss paper, or one in which a plastic film is stacked via an adhesive layer at a base material such as paper. Such plastic materials include, for example, polyvinyl chloride, polyethylene terephthalate, polycarbonate, polystyrene, polyurethane, polyethylene, and polypropylene.

The heating unit 90 for heating the medium S transported above the guide surface 58*a* after printing in the printing unit 70 is provided at a position facing the guide surface 58*a* of the downstream guiding unit 58. The heating unit 90 includes two opening portions 91 and 92 that are open toward the guide surface 58*a*, and are arranged in the transport direction, a communication path 93 that communicates the two opening portions 91 and 92, and an air blowing fan 94 provided in the communication path 93, and generating an airflow from one of the two opening portions 91 and 92 toward another.

Furthermore, the heating unit 90 includes a heater unit 95 that evaporates a solvent of ink adhering to the printed medium S after printing. The heater unit 95 is provided between the two opening portions 91 and 92 at a position facing the guide surface 58*a*. For example, an infrared heater that utilizes electromagnetic waves to evaporate ink is used in the heater unit 95. When the medium S is irradiated with an infrared ray by the heater unit 95, a gas including steam as a result of ink evaporated is taken into the communication path 93 from one opening portion of the two opening portions 91 and 92 by the air blowing fan 94. Then, when the gas passes through a collection unit provided in the communication path 93 for collecting the steam, the steam is collected, and is discharged from another opening portion of the two opening portions 91 and 92. In this manner, the ink of the medium S is dried by the air blowing fan 94 circulating the gas.

An operation unit 35 for performing a setting operation or an input operation is provided at an upper right portion of the housing 30. A container mounting portion 33 to which an ink accommodation container 34 capable of accommodating ink can be mounted is provided at a lower right portion of the housing 30. A plurality of the ink accommodation container 34 corresponding to ink of various kinds and colors are mounted to the container mounting portion 33. The ink accommodation container 34 and the head 71 are coupled by a flexible tube, and ink is supplied to the head 71.

Next, a spacer 80 provided above the guide surface 58*a* of the downstream guiding unit 58 will be described. The spacer 80 separates the medium S, transported above the guide surface 58*a* toward the heating unit 90, from the guide surface 58*a*.

Figures 4, 5:
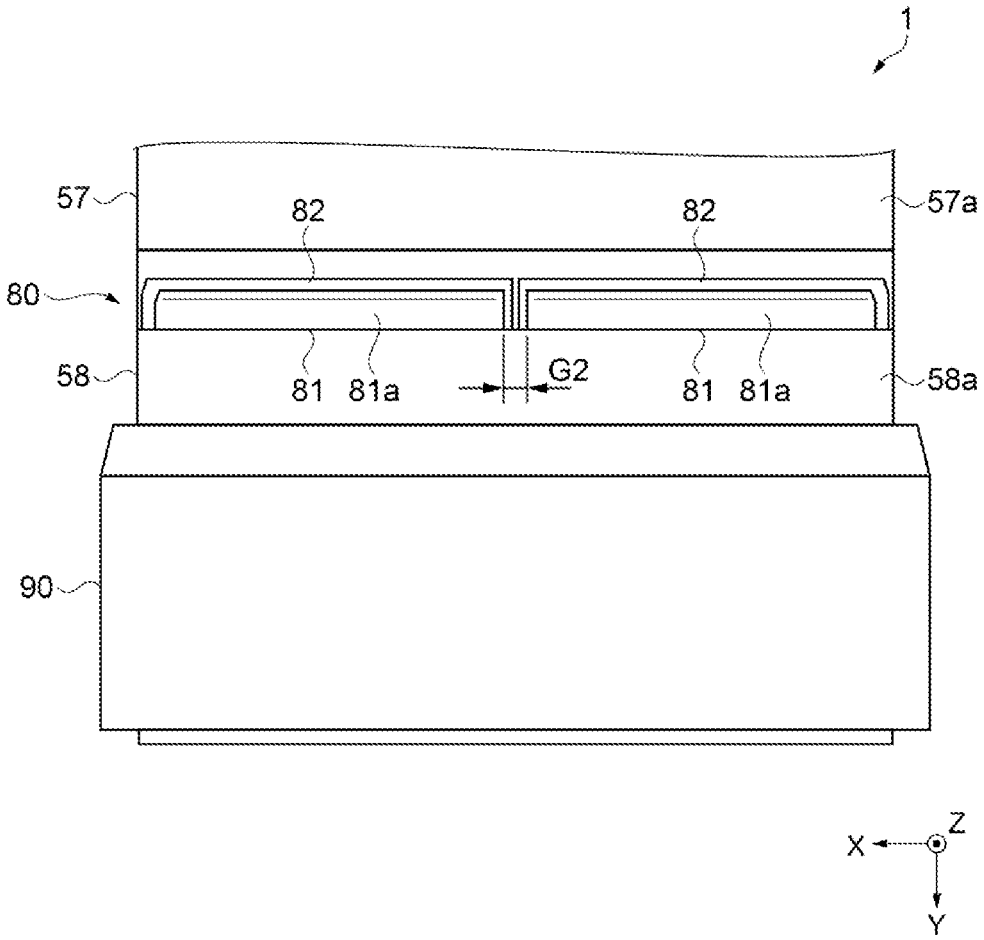
FIG. 4 is a plan view of the spacer and the heating unit as viewed from above.
FIG. 5 is a table showing evaluation results of media damage using a spacer height as a parameter.

As illustrated in FIG. 3 and FIG. 4, the spacer 80 is provided upstream the heating unit 90 above the guide surface 58*a*. The spacer 80 protrudes from the guide surface 58*a*, and extends in the X direction that intersects the transport direction of the medium S. Note that in FIG. 4, illustration of the housing 30 and the printing unit 70 is omitted.

The spacer 80 includes a sliding portion 81, a base portion 82, and a fitting portion 83. Further, the downstream guiding unit 58 is provided with a recessed portion 59 that is recessed in a rectangular shape in a direction intersecting the guide surface 58*a*. The guide surface 58*a* is formed of a stainless metal material subjected to an alumite treatment.

The sliding portion 81 is a rectangular plate member that is long along the X direction, and has a sliding surface 81*a* at an upper surface thereof that slides on the medium S. The sliding portion 81 is disposed such that the sliding surface 81*a* is substantially parallel with the guide surface 58*a* of the downstream guiding unit 58. Furthermore, the sliding portion 81 is disposed at a position where the sliding surface 81*a* is lower than the support face 57*a* of the platen 57 in a vertical direction. The sliding portion 81 including the sliding surface 81*a* is formed of an aluminum metal material subjected to an alumite treatment.

The base portion 82 supports the sliding portion 81 from below. An end portion upstream the base portion 82 has a wedge shape in which a height from the guide surface 58*a* of the downstream guiding unit 58 gradually increases, and a portion that supports the sliding portion 81 has a shape substantially parallel with the guide surface 58*a* of the downstream guiding unit 58. The base portion 82 and the sliding portion 81 are coupled by a fastening member, such as a screw, for example.

The fitting portion 83 protrudes from a lower surface of the base portion 82, and has a shape that follows an internal shape of the recessed portion 59 provided in the guide surface 58*a* of the downstream guiding unit 58. The spacer 80 is mounted to the downstream guiding unit 58, by fitting the fitting portion 83 into the recessed portion 59. In other words, the spacer 80 is configured to be detachable from the downstream guiding unit 58. The fitting portion 83 is integrally formed with the base portion 82 by a resin member. In a state in which the spacer 80 is mounted to the downstream guiding unit 58, a distance G1 between the guide surface 58*a* and the sliding portion 81 may be separated by 10 mm or greater via the base portion 82 formed of the resin member.

As illustrated in FIG. 4, the spacer 80 is split and disposed in a direction intersecting the transport direction. In the present exemplary embodiment, a configuration in which the spacer 80 is split into two portions and disposed is exemplified. A distance G2 in the direction intersecting the transport direction between the respective sliding portions 81 of the two divided spacers 80 may be 10 mm or greater. Note that, in the present exemplary embodiment, the spacer 80 is exemplified in the configuration in which an entire lower surface of the sliding portion 81 is supported by one base portion 82, however, the spacer may be configured to partially support the sliding portion 81 by a plurality of split base portions.

Next, a height H1 of the spacer 80, in a state of being mounted to the downstream guiding unit 58, with respect to the guide surface 58*a* will be described.

For example, when printing was performed using a resin ink on the medium S of polyvinyl chloride stacked on a base material of paper via an adhesive layer, there was a case where heating by the heating unit 90 after the printing causes media damage in which the medium S waves depending on a type of the medium S. It is conceivable that this is because moisture contained in the paper of the base material vaporizes upon heating by the heating unit 90, but there is an impermeable sheet of polyvinyl chloride on a front surface side, so moisture collects between a back surface of the medium S and the guide surface 58*a* of the downstream guiding unit 58. Therefore, the inventors discovered that by providing the downstream guiding unit 58 with the spacer 80, to separate the medium S from the guide surface 58*a*, and release the vaporized moisture from a gap thereof, the media damage is improved.

FIG. 5 shows a relationship between the height H1 of the spacer 80 and media damage improvement effects, when experiment was performed using the height H1 of the spacer 80, that is, the height H1 of the sliding surface 81*a* with respect to the guide surface 58*a* as a parameter. The media damage was evaluated as three stages of "A", "B", and "C". "A" indicates a condition under which the media damage could be sufficiently improved. "B" indicates a condition under which improvement of the media damage was confirmed. "C" indicates a condition under which the media damage was not improved. In FIG. 5, the height H1 of the spacer 80 may be 15 mm or greater, and less than a gap H2 between the guide surface 58*a* and the heating unit 90. Because the gap H2 of the printing apparatus 1 according to the present exemplary embodiment is approximately 25 mm, the height H1 of the spacer 80 is set to 20 mm.

Note that in the present exemplary embodiment, the printing apparatus 1 having the configuration in which the spacer 80 is split into two portions and provided is exemplified, but in a small device that handles the medium S having a small width, a printing apparatus configured with one spacer 80 may be used. Furthermore, in a large device that handles the medium S having a large width, a printing apparatus having a configuration in which the spacer 80 is divided into three or more portions and provided may be used.

Note that in the present exemplary embodiment, the serial-head type printing apparatus 1 mounted to the carriage 72 that reciprocates in the main scanning direction, and while moving in the width direction of the medium S, discharges ink is exemplified, but a line head type printing apparatus may be used that extends in the width direction of the medium S, and is fixed, and arranged.

As described above, the printing apparatus 1 according to Exemplary Embodiment 1 can provide the following advantages.

The printing apparatus 1 includes the spacer 80 at the guide surface 58*a* facing the heating unit 90 for heating the medium S after printing in the printing unit 70. The medium S is separated apart from the guide surface 58*a* by the spacer 80. As a result, vaporized moisture generated when heated by the heating unit 90 can be released from the gap between the medium S and the guide surface 58*a*, without providing a slit in the guide surface 58*a*. Accordingly, the printing apparatus 1 that suppresses media damage and improves printing quality can be provided without sacrificing transport properties of the medium S.

The spacer 80 extends in the direction intersecting the transport direction. As a result, the medium S having a large width can be suitably separated from the guide surface 58*a*.

The spacer 80 is provided at the position where the sliding surface 81*a* of the sliding portion 81 is lower than the support face 57*a* of the platen 57. As a result, the medium S is suitably guided above the sliding surface 81*a*.

The height H1 of the spacer 80 is 15 mm or greater, and is less than the gap H2 between the guide surface 58*a* and the heating unit 90. By setting the height H1 of the spacer 80 to be 15 mm or greater, vaporized moisture generated between the medium S and the guide surface 58*a* can be effectively released. In addition, by making the height H1 of the spacer 80 less than the gap H2 between the guide surface 58*a* and the heating unit 90, the medium S can be suitably transported.

The sliding portion 81 and the guide surface 58*a* are formed of a metal member. As a result, wear due to that slidably contacts the medium S can be suppressed.

The spacer 80 is detachably provided at the downstream guiding unit 58. As a result, the spacer 80 can be easily attached and detached in accordance with a type or the like of the medium S in which media damage is likely to occur.

The fitting portion 83 is formed of a resin member. As a result, the fitting portion 83 can be easily formed in a shape that follows the internal shape of the recessed portion 59. Also, the spacer 80 can be easily mounted to the recessed portion 59.

The guide surface 58*a* and the sliding portion 81 are separated by 10 mm or greater via a resin member. As a result, the sliding portion 81 can be suitably insulated from the guide surface 58*a*.

The spacer 80 is divided into the plurality of portions. As a result, the spacer 80 can be easily attached and detached. Also, by spacing the respective sliding portions 81 of the split spacers 80 apart by 10 mm or greater, the sliding portions 81 can be suitably isolated from each other.

2. Exemplary Embodiment 2

A schematic configuration of a printing apparatus 100 according to Exemplary Embodiment 2 will be described. The printing apparatus 100 includes a lifting device 160 that lifts and lowers the spacer 180. Note that configurations identical to those in Exemplary Embodiment 1 will be denoted by the same reference signs and redundant descriptions will be omitted.

Figure 6:
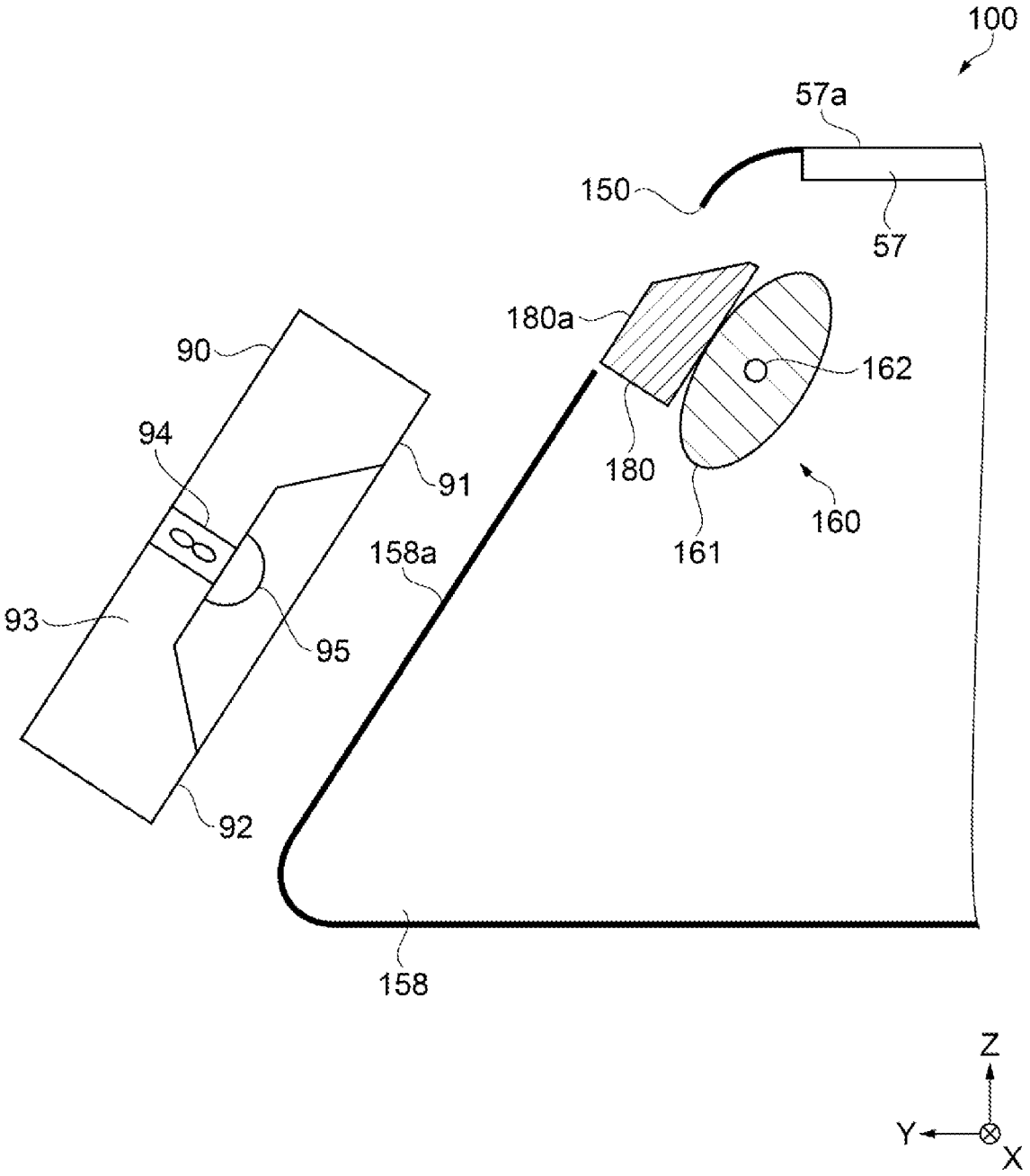
FIG. 6 is a cross-sectional view illustrating a spacer positioned at a first position of a printing apparatus according to Exemplary Embodiment 2.
Figure 7:
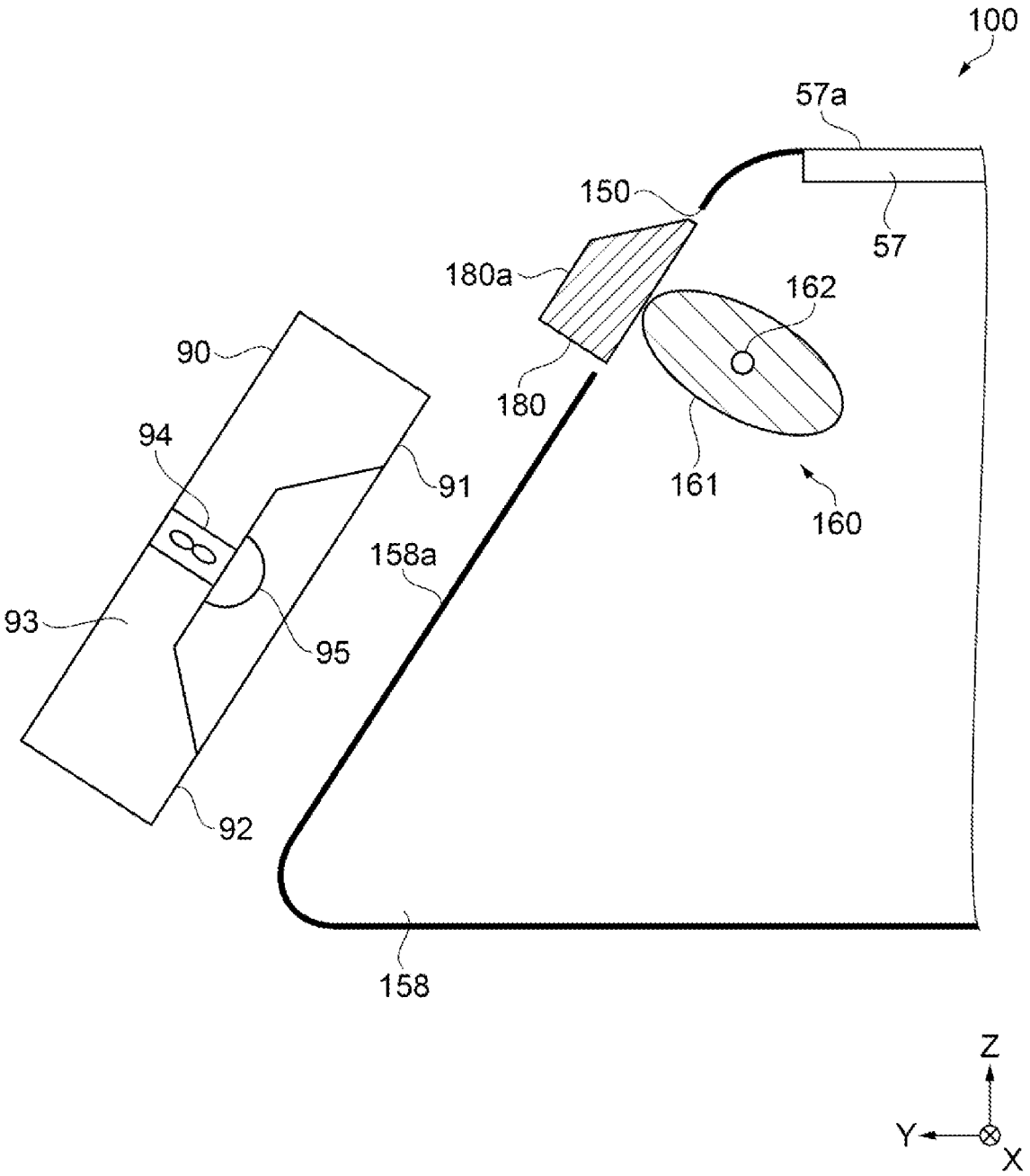
FIG. 7 is a cross-sectional view illustrating the spacer positioned at a second position.

As illustrated in FIG. 6 and FIG. 7, a downstream guiding unit 158 is provided downstream the platen 57. The downstream guiding unit 158 includes a guide surface 158*a* that guides the medium S downstream in a transport direction from the platen 57. The guide surface 158*a* is formed of a stainless metal material subjected to an alumite treatment. The heating unit 90 for heating the medium S transported above the guide surface 158*a* after printing in the printing unit 70 is provided at a position facing the guide surface 158*a* of the downstream guiding unit 158.

The printing apparatus 100 includes a spacer 180 that separates the medium S, which is transported above the guide surface 158*a* toward the heating unit 90, from the guide surface 158*a*, and a lifting device 160 that lifts and lowers the spacer 180 with respect to the guide surface 158*a*. FIG. 6 illustrates a state in which the spacer 180 is lowered, and FIG. 7 illustrates a state in which the spacer 180 is lifted. The guide surface 158*a* upstream the heating unit 90 is formed with an accommodation portion 150 for accommodating the lifting device 160 and the lowered spacer 180.

As illustrated in FIG. 7, the spacer 180 is a rectangular plate member that is long along the X-direction, and an end portion upstream thereof has a wedge shape in which a height from the guide surface 158*a* of the downstream guiding unit 158 gradually increases. The spacer 180 has a sliding surface 180*a* that slides on the medium S on an upper surface thereof. The spacer 180 including the sliding surface 180*a* is formed of an aluminum metal material subjected to an alumite treatment.

The lifting device 160 is configured to include an eccentric cam 161 having a cam shaft 162, and a cam drive motor (not illustrated). The spacer 180 is biased to the eccentric cam 161 by a biasing member (not illustrated). When the cam drive motor is driven, the eccentric cam 161 rotates. As a result, the spacer 180 is displaced to a first position in which the sliding surface 180*a* forms a single plane with the guide surface 158*a* illustrated in FIG. 6, and to a second position in which the sliding surface 180*a* protrudes from the guide surface 158*a*, as illustrated in FIG. 7. Note that in the present exemplary embodiment, the lifting device 160 using the eccentric cam 161 is exemplified, but a lifting device configured using an air cylinder, a link mechanism, or the like may be used.

As described above, the printing apparatus 100 according to Exemplary Embodiment 2 can provide the following advantages.

The printing apparatus 100 includes the lifting device 160 that lifts and lowers the spacer 180. This makes it possible to easily protrude the spacer 180 from the guide surface 158*a* as necessary, when the medium S in which media damage is likely to occur is used, for example.

What is claimed is:

1. A printing apparatus, comprising:

a transport unit configured to transport a medium in a transport direction;

a printing unit configured to perform printing on the medium transported by the transport unit and supported by a platen;

a medium guiding unit having a guide surface for guiding the medium downstream in the transport direction from the platen;

a heating unit disposed at a position facing the guide surface, and configured to heat the medium; and a spacer provided above the guide surface, and configured to separate the medium from the guide surface.

2. The printing apparatus according to claim 1, wherein the spacer extends in a direction intersecting the transport direction.

3. The printing apparatus according to claim 1, wherein the spacer has a sliding surface that slidably contacts the medium, and the sliding surface is lower in a vertical direction than a support face of the platen supporting the medium.

4. The printing apparatus according to claim 3, wherein the spacer is provided upstream the heating unit in the transport direction, and a height of the sliding surface with respect to the guide surface is equal to or greater than 15 mm, and is less than a gap between the guide surface and the heating unit.

5. The printing apparatus according to claim 3, wherein the sliding surface and the guide surface are formed of a metal member.

6. The printing apparatus according to claim 1, wherein the medium guiding unit is provided with a recessed portion, and the spacer has a fitting portion configured to fit into the recessed portion, and is configured to be attached to and detached from the medium guiding unit.

7. The printing apparatus according to claim 6, wherein the fitting portion is formed of a resin member.

8. The printing apparatus according to claim 6, wherein the spacer includes a sliding portion that slidably contacts the medium, and the guide surface and the sliding portion are separated by 10 mm or greater via a resin member integrally formed with the fitting portion.

9. The printing apparatus according to claim 8, wherein the spacer is split into a plurality of portions and disposed in a direction intersecting the transport direction, and the respective sliding portions of a plurality of the split spacers are separated by 10 mm or greater along a direction intersecting the transport direction.

10. The printing apparatus according to claim 1, comprising:

a lifting device configured to lift and lower the spacer, wherein the spacer is configured to be displaced to a first position so as to form a single plane with the guide surface, and to a second position so as to protrude from the guide surface.

* * * * *